United States Patent [19]

Halder

[11] Patent Number: 4,628,251

[45] Date of Patent: Dec. 9, 1986

[54] PRECISION MEASUREMENT VOLTAGE TRANSDUCER

[75] Inventor: Mathis Halder, Baar, Switzerland

[73] Assignee: LGZ Landis & Gyr Zug AG, Zug, Switzerland

[21] Appl. No.: 611,018

[22] Filed: May 16, 1984

[30] Foreign Application Priority Data

Jun. 1, 1983 [CH] Switzerland ..... 2994/83

[51] Int. Cl.[4] ..... G05F 7/00

[52] U.S. Cl. ..... 323/340; 323/356; 324/127

[58] Field of Search ..... 323/340, 355, 356, 359; 324/127

[56] References Cited

U.S. PATENT DOCUMENTS 3,881,149 4/1975 Kiko ..... 323/356
4,054,829 10/1977 Searle ..... 323/356

FOREIGN PATENT DOCUMENTS 1488262 10/1977 United Kingdom ..... 324/127
2034998 6/1980 United Kingdom .
617735 7/1978 U.S.S.R. ..... 324/127

*Primary Examiner*—William H. Beha, Jr.
*Attorney, Agent, or Firm*—Marmorek, Guttman & Rubenstein

[57] ABSTRACT

A precision measurement voltage transducer is fed from a reference alternating current source and comprises a transformer and a servo amplifier. The transformer comprises a feedback winding, a magnetizing winding and an output winding. The feedback winding and the magnetizing winding together with the servo amplifier form a feedback control regulating system, which adjusts the input voltage of the servo amplifier to zero. The latter comprises two amplifiers, which according to a first embodiment are connected in series and which according to a second embodiment feed the two poles of the primary winding of a second transformer, the secondary winding of which forms the output of the servo amplifier. According to the first embodiment the second amplifier is provided with a positive and an equally strong negative feedback and according to the second embodiment the transfer ratio of the second transformer equals the amplification factor of the second amplifier.

19 Claims, 3 Drawing Figures

PRECISION MEASUREMENT VOLTAGE TRANSDUCER

BACKGROUND OF THE INVENTION

1. Field of the Invention

The present invention relates to a precision measurement voltage transducer or converter of high accuracy based on a transformer and a servo amplifier.

2. Brief Description of the Background of the Invention Including Prior Art

Measurement voltage transducers are used for example in testing stations for electricity meters, watt meters, voltage meters, test counters, test scoring machines, and other precision apparatus. Such a measurement voltage transducer or converter is known for example from the British Document GB-OS No. 2,034,998A. The output of the amplifier employed according to the reference is on the one hand connected via a transformer winding to ground and on the other hand via another transformer winding and a resistor fed back to the inverting input of the amplifier.

In the case where transformers are employed the errors introduced by measurement voltage transducers depend strongly on the magnetic material employed, that is on the lamination of the transformer. This dependency is avoided in the British Document by having the decisive windings of the transformer carry no substantial current such that the copper resistance and the leakage stray induction does not become effective. This requires the presence of a magnetization winding on the transformer, which excited the transformer core such that the required internal voltage appears at a feedback winding generating a negative feedback. However, no substantial current flows in the feedback winding, since it is loaded with the high resistance input resistor of an amplifier. An active compensation, that is an automatic control, takes care that this internal voltage is adjusted such that a reference alternating voltage supplying the measurement voltage transducer appears at the terminals of the feedback winding. This construction provides the advantage that the magnetizing power does not have to be supplied completely by the servo amplifier, but that the main part is provided by the reference voltage source and only a small part of at most 1 percent is to be produced by the servo amplifier. This results in the advantage that the servo amplifier and its power supply do not have to be dimensioned too large and that the amplification can be smaller with the same quality result and that the "offset" voltage, which can easily lead to saturation of the transformer core, can be controlled in a better way.

SUMMARY OF THE INVENTION

1. Purposes of the Invention

It is an object of the invention to provide an improved measurement voltage transducer where a smaller number of transformer windings are required and where the influence of the "offset" voltage of the servo amplifier is avoided without generation of oscillations in the control circuit.

It is another object of the present invention to provide a measurement voltage transducer which avoids to have the servo amplifier deliver all its current in a nonusual operational range, for which commercial operational amplifiers are not designed.

It is a further object of the present invention to provide a measurement voltage transducer which avoids that the supply of the servo amplifier results in a very low degree of effectivity under the operational conditions.

These and other objects and advantages of the present invention will become evident from the description which follows.

2. Brief Description of the Invention

The present invention provides a precision measurement voltage transducer which comprises a reference voltage source providing an alternating voltage, a servo amplifier having an input and an output, a magnetic coupling means, a feedback winding engaging the magnetic coupling means and feeding the reference voltage from the reference source to the input of the servo amplifier, an output winding engaging the magnetic coupling means and having an output, and a magnetizing winding engaging the magnetic coupling means and connecting the reference source voltage and the output of the servo amplifier, where the output of the servo amplifier is magnetically inductively engaging the feedback winding via the magnetizing winding such that the resulting input voltage of the servo amplifier is approximately zero and the voltage drop in the feedback winding is transformed into an output voltage at the output winding corresponding to the number of turns of the output winding and of the feedback winding.

The servo amplifier can include a first amplifier, where the input of the servo amplifier is at the same time the input of the first amplifier, and a second amplifier, where the output of the servo amplifier is at the same time the output of the second amplifier and where the first and second amplifier are connected in series. The input of the second amplifier can be connected via a first resistor to the inverting input of a regulating operational amplifier, the output of the regulating operational amplifier can be simultaneously the output of the second amplifier, wherein the output of the regulating operational amplifier can be connected via a parallel circuit of a second resistor and of a capacitor to the inverting input for generating a negative feedback, wherein the output of the regulating operational amplifier can be connected via a third resistor for forming a positive feedback to the non-inverting input of the regulating operational amplifier, where the non-inverting input of the regulating operational amplifier can additionally be connected via a fourth resistor to ground, and where the positive and negative feedback of the second amplifier can be about equally strong.

The first amplifier can have an amplification factor of from about 0.6 to 1.5 and preferably from about 0.9 to 1.1 and more preferred is an amplification factor of 1 and it can be connected as a voltage follower. Alternatively, the first amplifier has an amplification factor which is very much larger than one or which is at least about 2. The magnetizing windings and the feedback winding can be provided with taps.

The servo amplifier can include a second transformer, where the input of the servo amplifier is at the same time the input of a first amplifier, where the output of the servo amplifier is connected to the input of a second amplifier, where the outputs of the first and second amplifier are each fed to one of the poles of the primary winding of the second transformer, where the output of the servo amplifier is formed by the secondary winding of the second transformer, and where the transfer ratio of the second transformer is equal to the amplification factor of the second amplifier.

The first amplifier can have an amplification factor which is at least about 2. The inverting input of the first and second amplifier can be connected each to the respective output via a parallel circuit of a resistor and of a capacitor and is connected each to ground via a resistor.

There is also provided a precision method for transducing a voltage which comprises feeding a reference alternating voltage to a magnetizing winding and to a feedback winding of a transformer, passing the voltage at the other side of the feedback winding to the input of a servo amplifier, inductively engaging the feedback winding by the current from an output of the servo amplifier via the magnetizing winding for reducing the input voltage of the servo amplifier to nearly zero, and transforming the voltage drop in the feedback winding into an output voltage at an output winding corresponding to the number of turns in the feedback winding and the output winding.

The servo amplifier can include a first amplifier, where the input of the servo amplifier serves at the same time the input of the first amplifier, and a second amplifier, where the output of the servo amplifier provides at the same time the output of the second amplifier. An output of the first amplifier can be fed to an input of the second amplifier. The input of the second amplifier can be connected to the input of a regulating operational amplifier, and the output of the regulating operational amplifier is simultaneously the output of the second amplifier.

A negative feedback can be generated by feeding part of the output of the regulating operational amplifier via a parallel circuit of a second resistor and of a capacitor to the inverting input, and by forming a positive feedback with the output of the regulating operational amplifier via a third resistor connecting to the non-inverting input of the regulating operational amplifier, where the non-inverting input of the regulating operational amplifier is additionally connected via a fourth input to ground, and where the positive and negative feedback of the second amplifier are equally strong.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
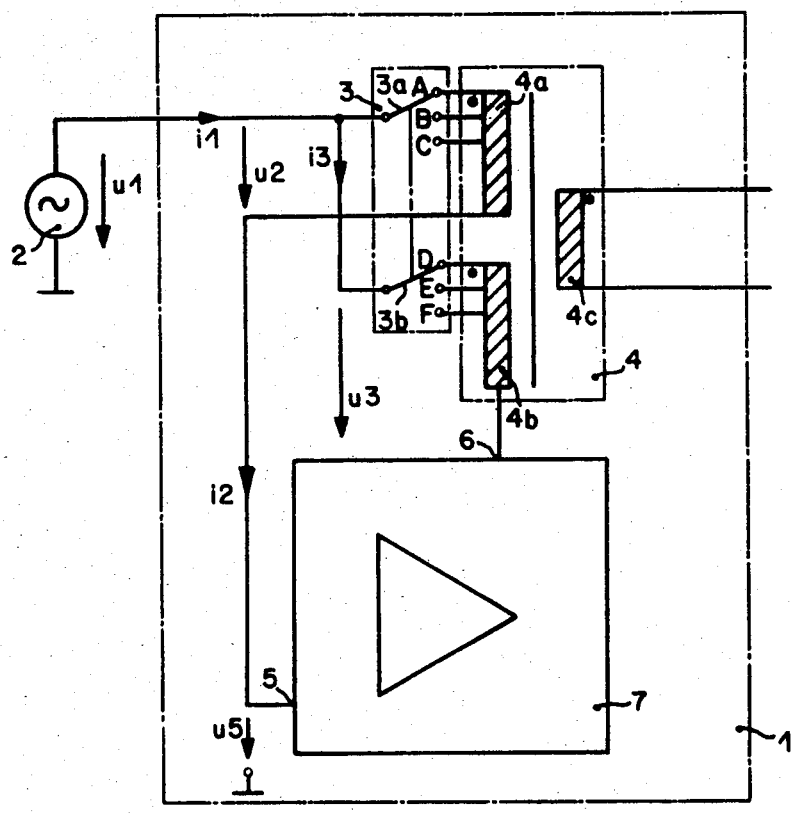
FIG. 1 is a view of a schematic circuit diagram of a measurement voltage transducer.

In accordance with the present invention there is provided a precision measurement voltage transducer which comprises a reference alternating voltage, which is connected via a feedback winding to the input of a servo operational amplifier and which comprises in addition to the servo operational amplifier as a transformer, which comprises a feedback winding, a magnetizing winding and an output winding, where the output of the servo operational amplifier is inductively effective on the feedback winding via the magnetizing winding such that the resulting input voltage of the servo operational amplifier is approximately zero, and the voltage drop in the feedback winding is transformed into an output voltage at the output winding corresponding to the number of turns of the output winding and the magnetizing winding **4*b* is connected on the one hand to the output of the servo operational amplifier 7** and is fed on the other hand by the reference alternating voltage.

The servo operational amplifier 7 can comprise a first amplifier 8 and a second amplifier 9, the input of the servo operational amplifier 7 can be at the same time the input of the first amplifier 8 and the two amplifiers can be connected in series. Furthermore, within the second amplifier 9 the input of the second amplifier 9 can be connected via a first resistor R1 to the inverting input of a regulating operational amplifier 10, the output of which is at the same time the output of the second amplifier 9 and which output is connected via a third resistor R3 for the formation of a positive feedback with the inverting input of the regulating operational amplifier 10, where the latter input is in addition connected to ground via a fourth resistor R4, and the positive and the negative feedback of the second amplifier 9 are of equal strength. The first amplifier 8 can have an amplification factor of 1 and can be connected as a voltage follower. The first amplifier 8 can have an amplification factor which is much larger than zero.

The servo amplifier 7 can comprise a first amplifier 8, a second amplifier 9 and a further transformer 12. The input 5 of the servo amplifier can be at the same time the input of the first amplifier 8, the output 6 of the servo amplifier 7 can be connected to the input of the second amplifier 9, and the outputs of the two amplifiers 8, 9 can be led to a pole of the primary winding **12*a* of a further transformer 12, the secondary winding of which 12*b* forms the output of the servo amplifier 7 and its transfer ratio (u4/u6) is equal to the amplification factor (k2) of the second amplifier 9. The first amplifier 8** can have an amplification factor which is much larger than 1.

Referring now to FIG. 1 there is shown that the input of the precision measurement voltage transducer 1 is fed with a low resistance alternating current source generating a reference alternating voltage u1. At the same time the input is connected in the following sequence on the one hand via a first switch contact **3*a* and with the aid of a tap A, B, or C via a feedback winding 4*a* to an input 5 and on the other hand via a second switch contact 3*b* and with the aid of a tap D, E, or F via a magnetizing winding 4*b* with the output 6 of a servo amplifier 7. The two windings 4*a* and 4*b* of course can comprise more than three taps. The two switching contacts 3*a* and 3*b* belong to a joint three position two pole switch 3 and the two identically constructed windings 4*a* and 4*b* belong to a transformer 4, which comprises a third winding, that is the output winding 4*c*. The two poles of this output winding 4*c* form the two pole output of the measurement voltage transducer 1**.

Figure 2:
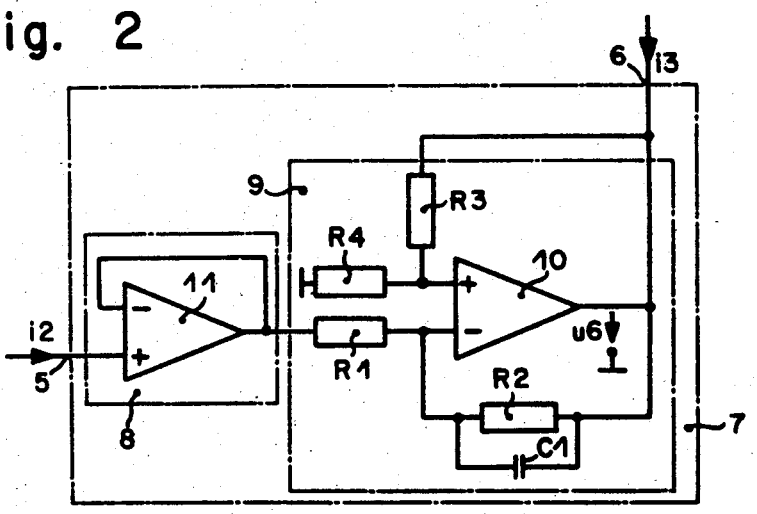
FIG. 2 is a view of a schematic circuit diagram of a first embodiment of the servo amplifier.

The first embodiment of the servo amplifier 7 according to FIG. 2 comprises a first amplifier 8 and a second amplifier 9. The input 5 of the servo amplifier 7 is at the same time the input of the first amplifier 8. The first amplifier 8 is connected in series with the second amplifier in this first embodiment, where the input of the second amplifier 9 is connected in the amplifier 9 via a first resistor R1 to the inverting input of a regulated operational amplifier 10. The output of the regulated operational amplifier 10, which output is at the same time the output of the amplifier 9, is connected via a parallel circuit R2; C1 with the inverting input for formation of a negative feedback and via a third resistor R3 with the non-inverting input of the regulated operational amplifier 10 for the formation of a positive feedback. The noninverting input of amplifier 10 is also connected to ground via a forth resistor R4. The parallel circuit R2; C1 comprises a second resistor R2 and a capacitor C1.

The resistor R1 is approximately equal to the resistor R4 and the resistor R2 is approximately equal to the resistor R3, that is the two feedbacks are about equally strong.

In a preferred embodiment of the invention the amplifier 8 has an amplification factor of about 1. Alternatively, the amplifier 8 has an amplification factor larger than 1 and is connected as a voltage follower based on a second operational amplifier 11 according to FIG. 2 in a conventional way. In particular, the output of the operational amplifier 11, which is at the same time the output of the first amplifier 8, and the inverting input of the operational amplifier 11 are directly connected to each other, while its non-inverting input forms the input of the amplifier 8.

Figure 3:
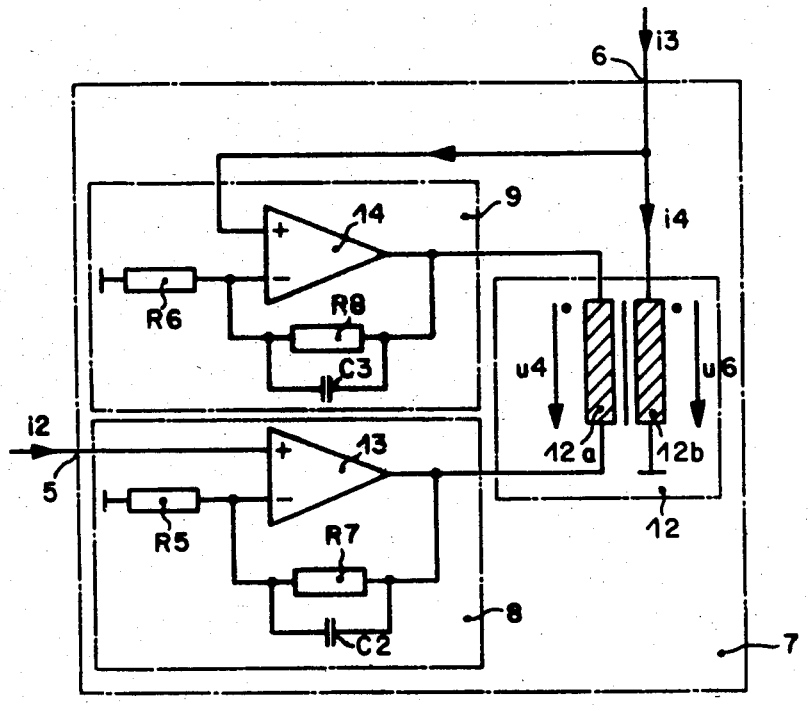
FIG. 3 is a view of a schematic circuit diagram of a second embodiment of the servo amplifier.

A second embodiment is shown in FIG. 3. Again a first amplifier 8 and a second amplifier 9 are provided. The circuit further comprises a transformer 12 having a primary winding 12*a* and a secondary winding 12*b*. The input 5 of the servo amplifier 7 again coincides with the input of the amplifier 8, in contrast the output 6 of servo amplifier 7 is connected to the input of the amplifier 9. The output of each of the two amplifiers 8 and 9 is led according to this embodiment to a corresponding pole of the primary winding 12*a*, while the secondary winding 12*b* is connected at one pole to ground and its other pole is connected to the output 6 of the servo amplifier 7 and thus forms the output of the servo amplifier 7. The transfer ratio u4/u6 of the further transformer 12 is to be selected equal to the amplification factor k2 of the amplifier 9. U4 designates the primary voltage and u6 the output voltage of the servo amplifier 7, which is here equal to the secondary voltage of the further transformer 12.

The two amplifiers 8 and 9 of the second embodiment are for example identically constructed. However, they can provide different amplifications based on the selection of differing resistance values. For example, they comprise in each case an operational amplifier 13 or, respectively, 14, which in a conventional way is connected as a non-inverting amplifier with a ground connected resistor R5 or, respectively, R6 with a feedback capacitor C2 or, respectively, C3, where the feedback resistor R7 or, respectively, R8 in each case is connected in parallel to the respective feedback capacitor C2 or, respectively, C3 and the feedback in each case is disposed between the output of the operational amplifier 13 or, respectively, 14 and its inverting input, while the resistor R5 or, respectively, R6 in each case have the inverting input connected to ground.

The operation of the precision measurement voltage transducer is as follows. The magnetizing winding 4*b*, the servo amplifier 7 and the feedback winding 4*a* form an automatic control regulating circuit according to both the first and second embodiment. The automatic control regulating circuit operates such that the input voltage u5 of the servo amplifier 7 is approximately equal to zero, that is the voltage drop via the feedback winding 4*a* is approximately equal to the reference voltage u1.

This is achieved in the following way:

Since the input resistor of amplifier 8 has a high resistance in both embodiments, also the input resistance of the servo amplifier 7 is always of high resistance, that is the current 12, which flows through the feedback winding 4*a*, is approximately equal to zero such that i1=i2+i3, where i1 is the current provided by the alternating current source and i3 is the current flowing through the magnetizing winding 4*b*. According to the first embodiment the current i3 flows through the magnetizing winding 4*b* (compare FIG. 1) and through the low resistance output resistor of the regulating operational amplifier 10 via the output 6 of the servo amplifier 7 at the second amplifier 9 (compare FIG. 2). According to the second embodiment the current i3 also flows through the magnetizing winding 4*b* (compare FIG. 1) and through the secondary winding 12*b* of the further transformer 12 via the output 6 of the servo amplifier 7 in the second amplifier 9 (compare FIG. 3).

According to both embodiments this current i3 induces a currentless voltage u2 in the feedback winding 4*a* via the core of the transformer 4 and the voltage u2 operates against the reference voltage u1.

The following equations hold:

$$u1=u2+u5=u3+u6$$

where u3 is the voltage drop via the magnetizing winding 4*b*, and $|u6|=k.u5$, where k is the amplification factor of the servo amplifier 7.

According to the first embodiment according to FIG. 2 holds that the input difference voltage of each operational amplifier has to be zero under neglection of the input currents of the high resistance inputs of the regulating operational amplifier 10:

$$k1.u5+(u6-k1.u5).R1/(R1+R2)-u6.R4/(R3+R4)=0, \text{ or with } R1=R4 \text{ and } R2=R3,$$

$$k1.u5-k1.u5.R1/(R1+R2)=0.$$

Since R1/(R1+R2) is always different from 1, therefore as already mentioned, u5=0.

k1 designates the amplification factor in the above equations of the first amplifier 8 and is for example equal to 1.

In contrast, the following holds according to the second embodiment:

$$u4=k2.u6-k1.u5 \text{ and}$$

$$u6=u4/k3,$$

where k2 represents the amplification factor of the second amplifier 9 and k3 represents the transfer ratio u4/u6 of the further transformer 12.

Therefore, the following holds:

$$u6=u4/k3=(k2.u6-k1.u5)/k3.$$

The following holds after selecting k2=k3: u6=u6−(k1/k2).u5, that is here again one has u5=0.

Thus according to both of the two embodiments the output of the servo amplifier 7 acts via the magnetizing winding 4*b* such inductively on the feedback winding 4*a* that the resulting input voltage u5 of the servo amplifier 7 is zero.

Since in addition according to equation (2) the relationship u6=k.u5 holds, also u6 is according to the two embodiments approximately zero or at least very small, such that according to equation (1) approximately u1=u2=u3 holds.

The voltage drop through the feedback winding 4*a* is in the following transformed into an output voltage at the output winding 4*c* corresponding to the number of turns of the output winding 4*c* and of the feedback winding 4*a*.

The switch 3, the tap A, B, or C of the feedback winding 4*a* and the tap D, E, or F of the magnetizing winding 4*b* serve only to receive at the output of the measurement voltage transducer 1 always the same output voltage for different values of the reference voltage u7.

It will be understood that each of the elements described above, or two or more together, may also find a useful application in other types of voltage converter system configurations and signal processing procedures differing from the types described above.

While the invention has been illustrated and described as embodied in the context of a precision measurement voltage transducer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A precision measurement voltage transducer comprising a reference voltage source providing an alternating voltage;

a servo amplifier having an input and an output;

a magnetic coupling means;

a feedback winding engaging the magnetic coupling means and feeding the reference voltage from the reference source to the input of the servo amplifier;

an output winding engaging the magnetic coupling means and having an output; and a magnetizing winding engaging the magnetic coupling means and connecting the reference source voltage and the output of the servo amplifier, where the output of the servo amplifier is magnetically inductively engaging the feedback winding via the magnetizing winding such that the resulting input voltage of the servo amplifier is approximately zero and the voltage drop in the feedback winding is transformed into an output voltage at the output winding corresponding to the number of turns of the output winding and of the feedback winding.

2. The precision measurement voltage transducer according to claim 1 wherein the servo amplifier includes a first amplifier, where the input of the servo amplifier is at the same time the input of the first amplifier, and a second amplifier, where the output of the servo amplifier is at the same time the output of the second amplifier and where the first and second amplifier are connected in series.

3. The precision measurement voltage transducer according to claim 2 wherein the input of the second amplifier is connected via a first resistor to the inverting input of a regulating operational amplifier, the output of the regulating operational amplifier is simultaneously the output of the second amplifier, wherein the output of the regulating operational amplifier is connected via a parallel circuit of a second resistor and of a capacitor to the inverting input for generating a negative feedback, wherein the output of the regulating operational amplifier is connected via a third resistor for forming a positive feedback to the noninverting input of the regulating operational amplifier, where the non-inverting input of the regulating operational amplifier is additionally connected via a fourth resistor to ground, and where the positive and negative feedback of the second amplifier are equally strong.

4. The precision measurement voltage transducer according to claim 2 wherein the first amplifier has an amplification factor of from about 0.9 to 1.1 and is connected as a voltage follower.

5. The precision measurement voltage transducer according to claim 2 wherein the first amplifier has an amplification factor which is at least about 2.

6. The precision measurement voltage transducer according to claim 1 wherein the magnetizing winding and the feedback winding are provided with taps.

7. The precision measurement voltage transducer according to claim 1 wherein the servo amplifier includes a first amplifier, a second amplifier, a second transformer, where the output of the servo amplifier is at the same time the input of the first amplifier, where the output of the servo amplifier is connected to the input of the second amplifier, where the outputs of the first and second amplifier are each fed to one of the poles of the primary winding of the second transformer, where the output of the servo amplifier is formed by the secondary winding of the second transformer, and where the transfer ratio of the second transformer is equal to the amplification factor of the second amplifier.

8. The precision measurement voltage transducer according to claim 7 wherein the first amplifier has an amplification factor which is at least about 2.

9. The precision measurement voltage transducer according to claim 7 wherein the inverted input of the first and second amplifier are connected each to the respective output via a parallel circuit of a resistor and of a capacitor and are connected each to ground via a resistor.

10. A precision method for transducing a voltage comprising feeding a reference alternating voltage to a magnetizing winding and to a feedback winding of a transformer; passing the voltage at the other side of the feedback winding to the input of a servo amplifier;

inductively engaging the feedback winding by the current from an output of the servo amplifier via the magnetizing winding for reducing the input voltage of the servo amplifier to nearly zero; and transforming the voltage drop in the feedback winding into an output voltage at an output winding corresponding to the number of turns in the feedback winding and the output winding.

11. The precision method for transducing a voltage according to claim 10 wherein the servo amplifier includes a first amplifier, where the input of the servo amplifier serves at the same time the input of the first amplifier, and a second amplifier, where the output of the servo amplifier provides at the same time the output of the second amplifier and further comprising feeding an output of the first amplifier to an input of the second amplifier.

12. The precision method for transducing a voltage according to claim 11 wherein said feeding step comprises feeding the output voltage signal of said first amplifier to the input of a regulating operational amplifier by way of a resistive element, said regulating operational amplifier being incorporated into said second amplifier, the output of said regulating operational amplifier simultaneously serving as the output of said second amplifier.

13. The precision method for transducing a voltage according to claim 12 further comprising generating a negative feedback by feeding part of the output of the regulating operational amplifier via a parallel circuit of a second resistor and of a capacitor to the inverting input;

forming a positive feedback with the output of the regulating operational amplifier via a third resistor connecting to the non-inverting input of the regulating operational amplifier, where the non-inverting input of the regulating operational amplifier is additionally connected via a fourth resistor to ground, and where the positive and negative feedback of the second amplifier are equally strong.

14. The precision method for transducing a voltage according to claim 11 wherein said passing step comprises passing the voltage at the other side of said feedback winding into said first amplifier comprising part of said servo-amplifier and amplifying the signal passed into said first amplifier by an amplification factor in the approximate range of 0.9 to 1.1.

15. The precision method for transducing a voltage according to claim 11 wherein said passing step comprises passing the voltage at the other side of said feedback winding into said first amplifier comprising part of said servo-amplifier and amplifying the signal passed into said first amplifier by an amplification factor of at least about 2.

16. The precision method for transducing a voltage according to claim 10 wherein the magnetizing winding and the feedback winding are provided with taps and said method includes the step of setting a switch capable of communication with said taps.

17. The precision method for transducing a voltage according to claim 10 wherein the servo amplifier includes first and second amplifiers and a further transformer and said method further comprises the steps of feeding the input of the servo amplifier to the input of the first amplifier and feeding the outputs of the first and second amplifiers to first and second poles of the primary winding of said further transformer, where the output of the servo amplifier is formed by the secondary winding of the second transformer, and where the transfer ratio of said further transformer is equal to the amplification factor of the second amplifier.

18. The precision method for transducing a voltage according to claim 17 wherein the input signal of said first amplifier is amplified by a factor of at least about 2.

19. The precision method for transducing a voltage according to claim 17 further comprising the step feeding back the output of said first and second amplifiers to the respective inverting inputs of said first and second amplifiers by way of first and second feedback circuits respectively, each feedback circuit comprising a resistor and capacitor in parallel.

* * * * *